United States Patent [19]

Uematsu

[11] 4,230,098

[45] Oct. 28, 1980

[54] RHYTHMICAL TRACTION TYPE DEVICE FOR MEDICAL TREATMENT

[76] Inventor: Kazuma Uematsu, 1-17-3 Oyamadai, Setagaya-ku, Tokyo, Japan

[21] Appl. No.: 11,934

[22] Filed: Feb. 13, 1979

[51] Int. Cl.[3] ..... A61H 1/00

[52] U.S. Cl. ..... 128/33; 128/52; 128/57; 128/71

[58] Field of Search ..... 128/33, 57, 24.3, 51, 128/52, 71

[56] References Cited

U.S. PATENT DOCUMENTS

| | | | |
|---|---|---|---|
| 2,230,057 | 1/1941 | Hill | 128/57 |
| 3,003,497 | 10/1961 | Nunes | 128/57 |
| 3,446,205 | 5/1969 | Minohara | 128/57 |
| 3,664,333 | 5/1972 | Hill | 128/52 |
| 3,830,233 | 8/1974 | Hill | 128/71 |
| 4,154,232 | 5/1979 | Fukazawa | 128/52 |

*Primary Examiner*—Lawrence W. Trapp
*Attorney, Agent, or Firm*—McGlew and Tuttle

[57] ABSTRACT

A rhythmical traction type instrument for medical treatment including a couch having a movable frame mounted thereon in reciprocating fashion and a motor for moving said movable frame. This couch is fitted with a roller for correcting the backbone, a vibrator, a reciprocating roller for massaging the lumber and a roller for massaging the lower half of one's body. Each of the rollers and vibrator is provided with a motor for causing up or down movement thereof. Such instruments may also include a control circuit for actuating the required rollers according to a predetermined program or separately and an operation circuit for sending a signal to said control circuit.

10 Claims, 9 Drawing Figures

RHYTHMICAL TRACTION TYPE DEVICE FOR MEDICAL TREATMENT

BACKGROUND OF THE INVENTION

This invention relates to rhythmical traction type instruments for medical treatment comprising a couch provided with a plurality of rollers, a movable frame mounted on the couch in reciprocating fashion and a screen such as a canvas stretched over the movable frame. A patient is made to lay down on the screen stretched over the movable frame which, in turn, is moved while the patient is subjected to rythmical traction and rubbing by said rollers.

In the instruments of this type which have heretofore been known in the art, it was impossible to regulate the heights of the rollers involved. When it was required to vary the heights of the rollers, said rollers had to be replaced with those having different diameters. For such replacement, considerable time was required.

Furthermore, the position of a patient lying on the movable frame relative to a given roller could not be specified, thus rendering it impossible to locally treat that portion. For a certain patient, however, application of rollers to the specific portion of the patient may suffice for treatment. In the conventional instruments, however, the patient's body was always subjected to treatment. As a result, the treatment was less effective and time-consuming.

SUMMARY OF THE INVENTION

It is therefore a first object of this invention to provide an instrument for medical treatment in which the heights of rollers can freely be adjusted to regulate the force of traction thereof, and the rollers are arbitrarily selected in such a manner that some rollers which may become unnecessary for the purpose of certain treatment are lowered to a position where they do not come into contact with a patient's body.

Another object of this invention is to provide an instrument for medical treatment in which a movable frame is designed such that it stops in a state where the position of the waist of a patient is relatively in coincidence with that of a roller for massaging the lumbar, whereby the lumbar is locally treated by reciprocating said roller for massaging the lumbar.

Still another object is to provide an instrument for medical treatment in which, apart from the respective rollers, a vibrator is also incorporated to effect treatment due to its vibrations.

Further object is to make general improvements in the structure of an instrument for medical treatment.

A still further object of the present invention is to provide an apparatus for medical treatment of a patient which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
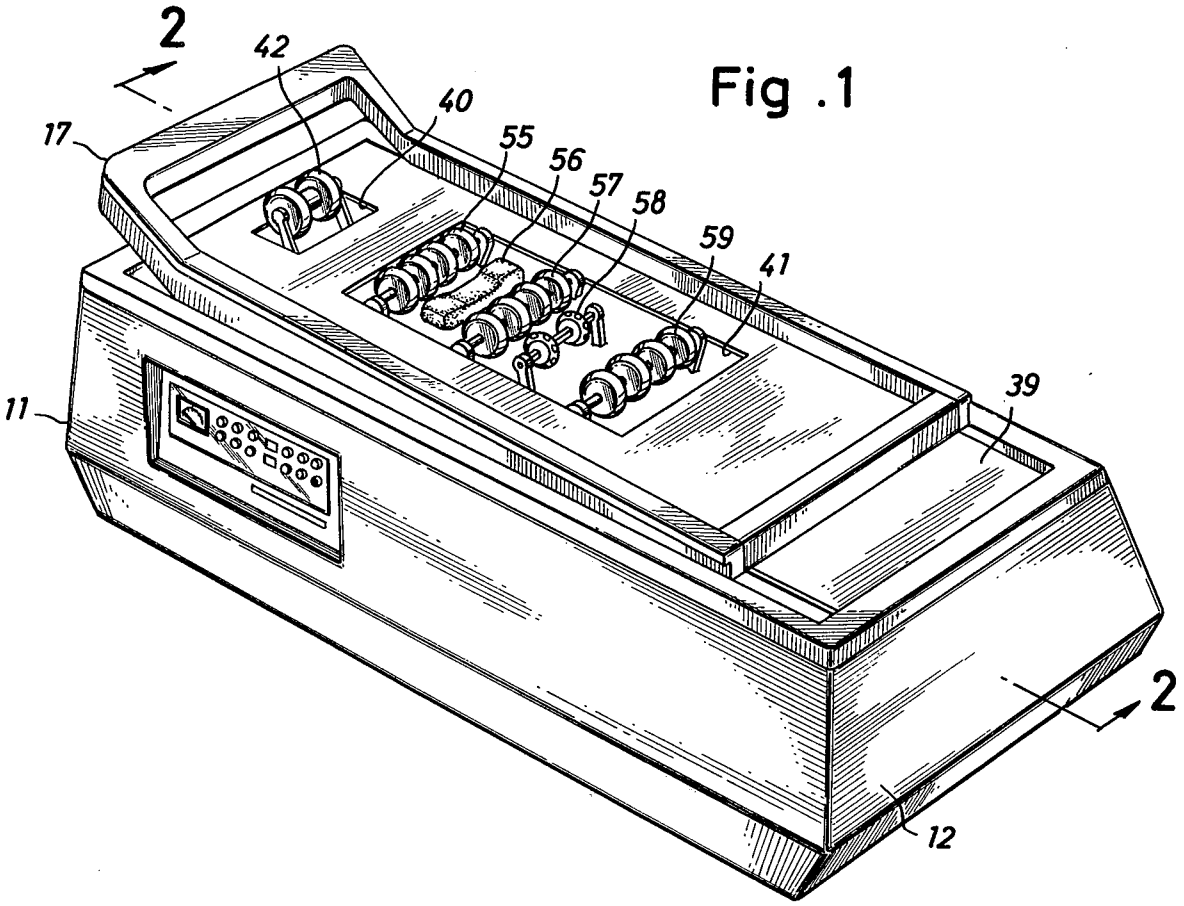
FIG. 1 is a perspective view generally showing the instrument for medical treatment according to this invention, in which a screen such as a canvas stretched around the movable frame has been removed.

Referring now to the drawings, particularly FIG. 1, there is shown a couch 11. The internal structure of couch 11, from in which a surrounding decorative panel 12 has been removed is, with reference to FIGS. 2 and 3, as follows:

A bottom frame 13, which is being rectangular in plane, is provided. Two pairs of columns 14 and 15 are vertically fixed on inward edges of the long sides of frame 13. A pair of rails 16 are laid on these columns 14 and 15. It is noted that the rail to be mounted on the side of columns 15 is not illustrated. As will be evident from FIGS. 7 and 8, each rail 16 is of air inverted L-shape in section so that its upper side projects between the opposite portions thereof, ie., inwardly.

A movable frame 17 is movably carried on the pair of rails 16. This movable frame 17 is rectangular in plane with its width being such that its long sides are positioned just above the rails 16. Two members for retaining wheels are provided inside both long sides of this movable frame 17 for a total of four. It is noted that only the members 18 for retaining the wheels on one long side of frame 17 is shown.

Figure 7:
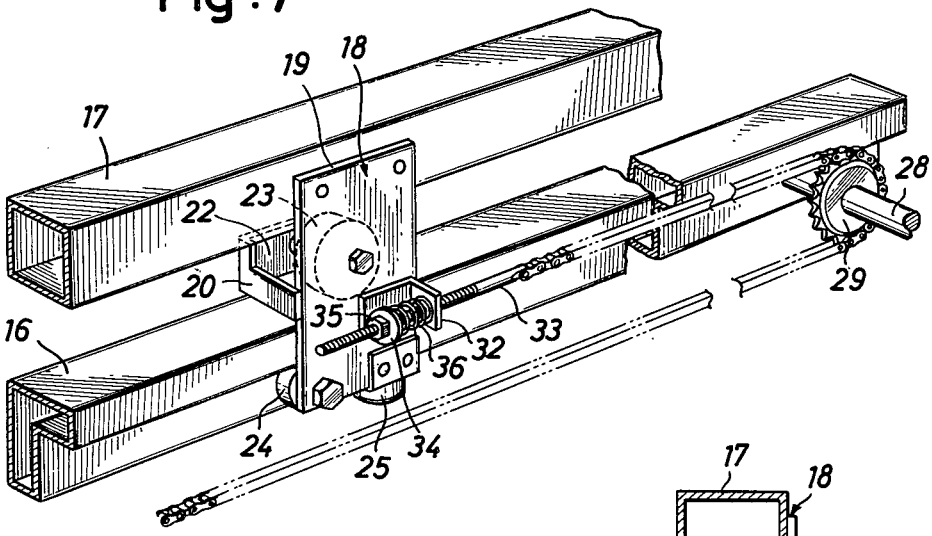
FIG. 7 is a partially perspective view showing the relationship between the movable frame and the rails.
Figure 8:
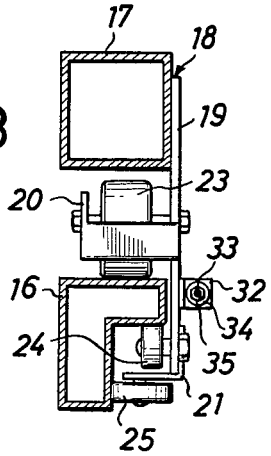
FIG. 8 is a side view of FIG. 7.
Figure 4:
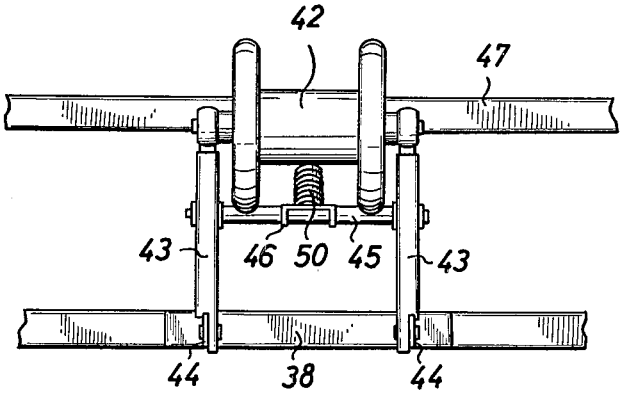
FIG. 4 is a plan view showing a mechanism for supporting the roller for tracting the cervical vertebrae.
Figure 5:
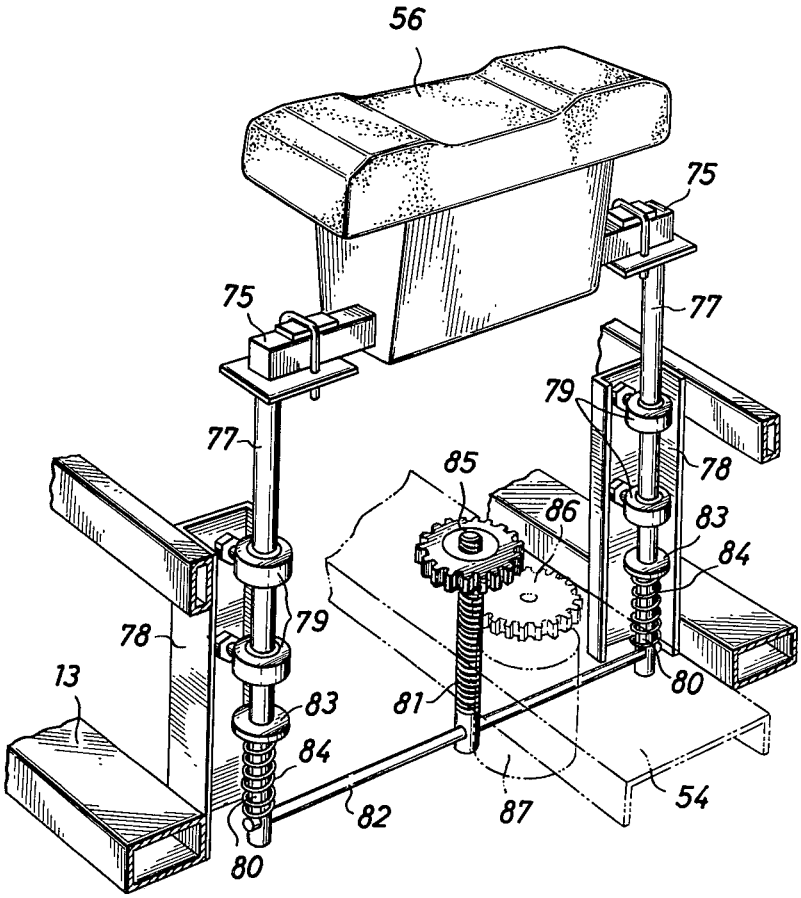
FIG. 5 is a perspective view showing a vibrator and a mechanism for supporting the same.

One of these members for retaining the wheels will now be explained with reference to FIGS. 7 and 8.

The member 18 for retaining the wheels comprises a support plate 19, which is fixed to the insides of the long side portions of the movable frame 17, an angle plate 20 and a horizontal plate 21 which are secured to the support plate 19. The support plate 19 has its lower and extending to the lower side of the rail 16, and the angle plate 20 has its one end fixed to the support plate 19 and its other end projecting outwardly from the support plate 19 so that its surface 22 is opposite the support plate 19. A wheel 23 is provided in between the opposite surface 22 and support plate 19 in such a manner that this wheel runs on rail 16 while sustaining the weight of the movable frame 17.

The lower side of the support frame 19 and the horizontal plate 21 are provided with auxiliary wheels 24 and 25, respectively, so that these wheels come into contact with the inside of rail 16 to prevent the movable frame 17 from running off the rail due to its rise or horizontal shift.

Figure 2:
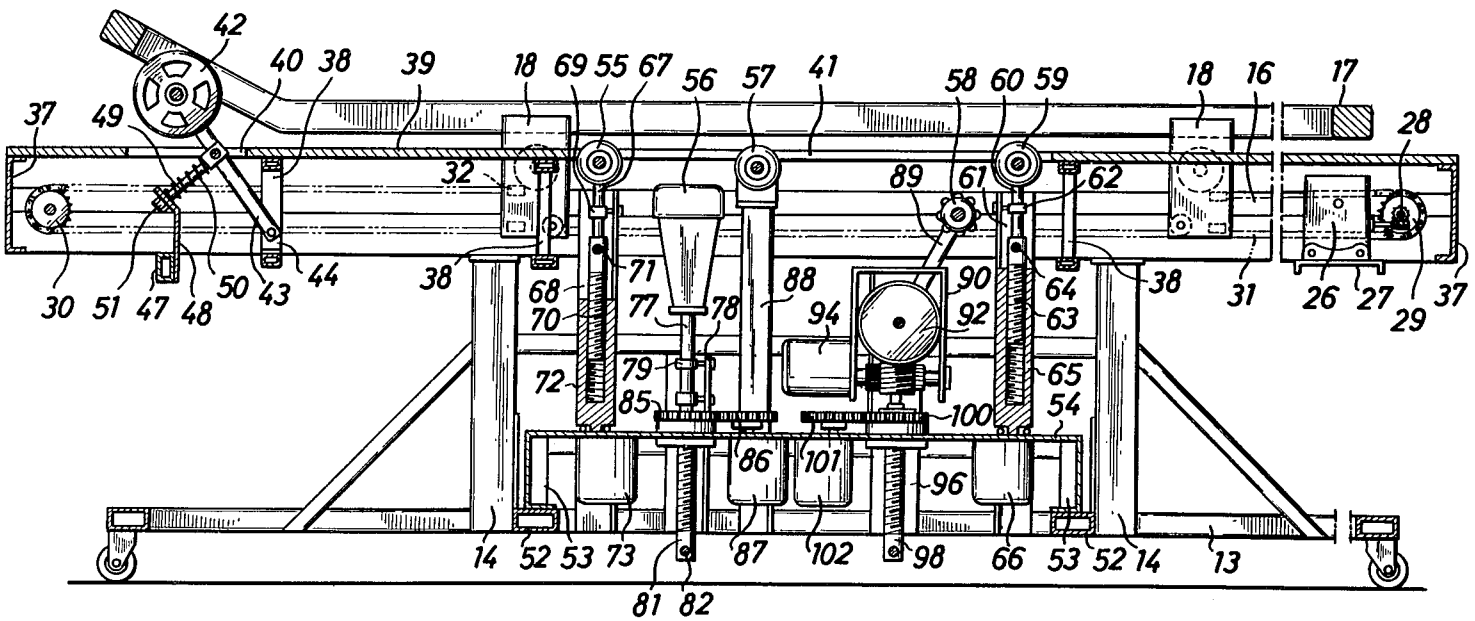
FIG. 2 is a sectional view taken along line II—II of FIG. 1, which shows the instrument in which a decorative panel stretched around a couch has been removed.
Figure 3:
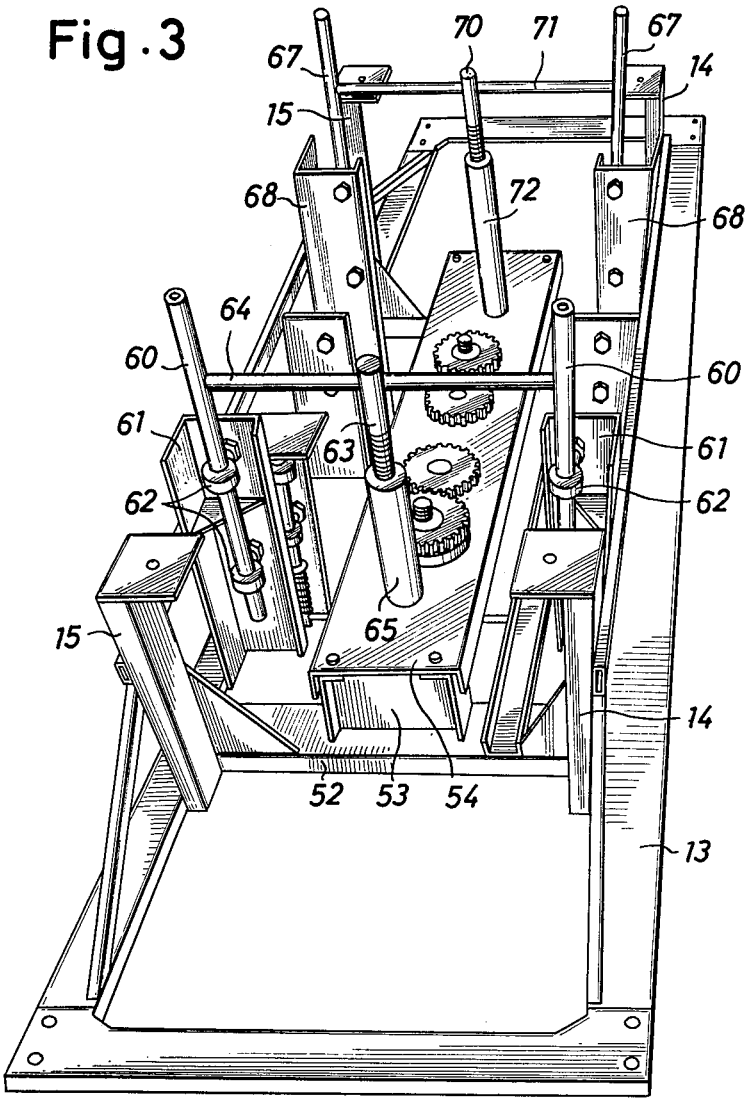
FIG. 3 is a perspective view, with part omitted for clarity, of the inside of the couch of FIG. 1.

A source for driving the movable frame 17 which is carried on the rails in this way is a driving motor 26 shown in FIG. 2.

The driving motor 26 is installed on a plate laid across one ends of the pair of rails 16 with its shaft being connected to a shaft 28 of a driving gear by way of a reduction gear not illustrated. Although the driving gear 29 is shown to be fixed to one end of shaft 28, this gear should be in fact secured to both ends thereof.

Driven gears 30 corresponding to the driving gears 29 are provided on the ends opposite thereto. Chains are respectively put around these driving gear 29 and driven gears 30 as well as driving gears and driven gears (not shown). Both ends of each chain are coupled to the member 18 for retaining the wheels. A coupling mechanism in connection with one end of a chain 31 will now be explained with reference to FIG. 7. The support plate 19 is fixedly provided at its given position with a projecting piece 32, through which a rod 33 coupled to one end of chain 31 slidably extends. This rod 33 is threaded at its end. A washer 24 and a nut 35 are fitted over the thus threaded portion, and a spring 36 is interposed between the washer 34 and the projecting piece 32.

Thus, driving of said driving motor 26 causes the chain to move and the movable frame 17 to run on the rails 16. This movable frame 17 is also provided with a screen such as a canvas on which a patient lies, the screen being designed to move along with the movable frame.

As illustrated in FIG. 2, the pair of rails 16 are fixedly provided on their both ends with retaining plates 37 each having its upper and lower ends bent at right angles. Each retaining plate 37 has its upper end positioned above the rails 16. A plurality of support frames 38 are also fixedly provided between the one pair of rails 16. The upper surfaces of each support frame 38 and each retaining plate 37 are maintained at the same level. A floor plate 39 is then laid on the retaining plates 37 and support frames 38. As will be evident from FIGS. 1 and 2, this floor plate 39 is positioned below the movable frame 17, and is provided with window openings 40 and 41 for exposing rollers (to be described later).

A roller 42 projecting upwardly from the window opening 40 is a roller for tracting the cervical vertebrae. A pair of support rods 43 for rotatably supporting a shaft projecting from both ends of roller 42 are rotatably mounted at their lower ends to a pair of projecting pieces 44 secured to the forefront support frame 38. A shaft 45 is mounted across the support rods 43, and is provided with a spring seat 46. A vertical piece 48 is fixed to a lateral member 47 laid across the rails at a position somewhat in front of the support frame 38, and is slightly tilted in the forward direction at its upper end. A rod 49 having its one end fixed to the spring seat 46 is then fitted with a spring 50, while the other end thereof is slidably inserted through the bent portion of the vertical piece 48 and is made to be in threading engagement with a nut 51.

Thus, when the weight of a patient lying on the movable frame 17 acts on the rollers 42 in the course of its travel, the rollers 42 turn in the counterclockwise direction (in FIG. 2) against the action of spring 50. The counter force of spring 50 then causes the roller 42 to push the cervical region of the patient up.

Turning to other details of the invention, a pair of beam members 52 are fixed into the bottom frame 13 and inside the columns 14 and 15, and are vertically provided with plate members 53 and 53, respectively. A panel 54 is laid across these plate members 53.

At a position corresponding to the window opening 41 are provided one or more rollers 55 for correcting the spine, a vibrator 56, one or more auxiliary rollers 57, one or more rollers for massaging the lumbar and one or more rollers 59 for tracting the lower half of one's body.

The roller 59 for tracting the lower half of one's body positioned in the rearward end of window 'is carried on bearings (not shown) having their shaft ends mounted on the upper ends of a pair of slide bars 60. As will be observed from FIG. 3, the one pair of slide bars 60 each having a bearing on its upper end, are each slidably supported on bearings 62 provided on retaining plates 61 which are vertically fixed to the bottom frame 13. Consequently, this roller 59 is vertically movable with respect to couch 11. A connecting rod 64 perpendicularly coupled to a screw stock 63 is interposed between the one pair of slide bars 60. The screw stock 63 is screwed into a rotary cylinder 65 the inner circumference of which is threaded. This rotary cylinder 65 is vertically provided on the panel 54, and is designed to be operatively associated with a motor 66 mounted on the undersurface of panel 54.

Accordingly, forward or rearward turning of motor 66 results in rotation of the rotary cylinder 65. When the rotary cylinder 65 turns in either direction, the screw stock 63 is elevated or lowered, thus leading to up or down movement of roller 59. When the screw stock 63 reaches the lowest position, the roller 59 reaches a position where it is below the plane of the floor plate 39, ie., it does not come into contact with the body of a patient. At the highest position, on the other hand, the stock projects upwardly from the plane of floor plate 39. The tractive force of this roller 59 with respect to the patient can then be adjusted by regulating the amount of projection of the stock.

A mechanism for supporting said forefront roller 55 for correcting the backbone is quite identical to that for roller 59. In other words, the slide bars 67 are coupled to both ends of the shaft of roller 55. Each slide bar 67 is then slidably supported on a bearing 69 provided on a retaining plate 68. A connecting rod 71 coupled perpendicularly to a screw stock 70 is interposed between these slide bars 67. This screw stock is then screwed into a rotary cylinder 72. The rotary cylinder 72 is vertically provided on panel 54, and is adapted to be operatively associated with a motor 73.

Consequently, forward or rearward turning of motor 73 results in up or down movement of roller 55.

Figure 9:
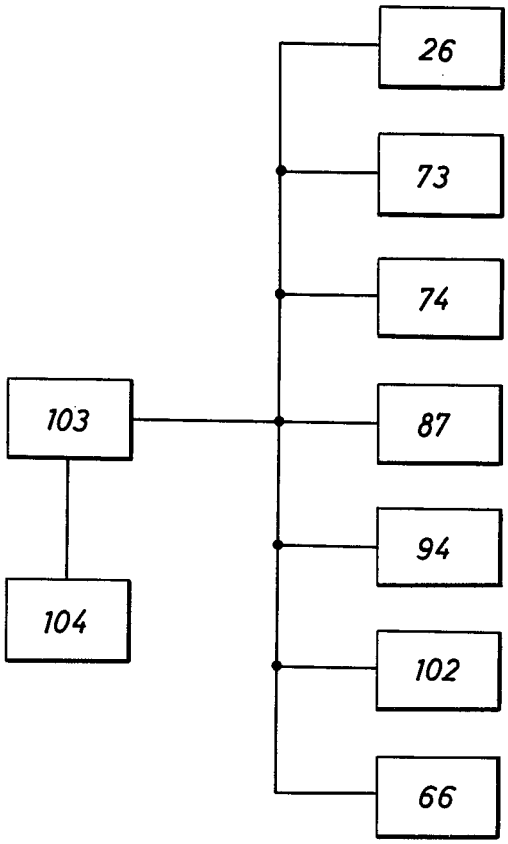
FIG. 9 is a block diagram showing a control circuit.

The vibrator 56 positioned to the rear of roller 55, includes therein a motor 74 for causing vibrations (which is illustrated only in the block diagram of FIG. 9). Arms 75 projecting from both ends of this vibrator 56 are then fixed onto the upper ends of slide bars 77 through plates 76. Each slide bar 77 is slidably supported on a bearing 79 provided on a retaining plate 78 which is vertically fixed to the bottom frame 13. The lower end of each slide bar 77 supported on bearing 79 formed on the retaining plate 78 is positioned below the panel 54, while this slide bar is provided on its lower side with a longitudinal hole 80 through which is inserted a connecting rod 82 coupled perpendicularly to a screw stock 81. A spring 84 is interposed between this connecting rod 82 and a stopper 83 provided on the slide bar 77. Furthermore, the screw stock 81 is caused to project upwardly beyond panel 54, and is meshed with a gear 85 rotatably mounted on panel 54. This gear 85 is meshed with a gear 86 rotatably mounted on panel 54 in a similar manner, the latter being connected to a motor 87 provided on the undersurface of panel 54 and being constructed such that it rotates together with motor 87.

Accordingly, as the motor 87 turns in the forward or rearward direction, the rotational force is transmitted to gear 85 through gear 86 so that the gear 85 rotates. Rotation of gear 85 causes the screw stock 81 to move up or down, with the result that the vibrator 56 is elevated or lowered. At the highest position, the vibrator 56 projects upwardly beyond the floor plate 39. At the lowest position, on the other hand, the vibrator reaches a position below the floor plate 39, ie., where it does not come into contact with the body of a patient.

When the vibrator 56 is caused to project upwardly beyond the floor plate 39, the movable frame 17 stops at a position where a portion to be treated of a patient lying on the movable frame 17 is in coincidence with the vibrator 56. As the vibrator 56 is caused to project upwardly beyond the floor plate 39, the patient's weight acts on the vibrator 56, but the spring 84 yields to exercise a cushioning action. If the motor 74 for causing vibrations within the vibrator 56 is driven in this state, the desired medical treatment will be accomplished.

The auxiliary roller 57 positioned in the rear of vibrator 56 is supported fixedly, ie., at a certain height on a retaining member 88 which is vertically provided on the bottom frame 13. The function of the auxiliary roller 57 is to prevent the patient's body from going down excessively when the vibrator 56 is being lowered.

The roller 58 for massaging the lumbar, which is positioned between the auxiliary roller 57 and roller 59, is designed such that both ends of its shaft are rotatably mounted on the upper ends of rocking bars 89. The lower ends of these rocking bars 89 are fixed to the rotating shaft of a reduction gear 92 installed within a casing 90 through a pair of longitudinal holes 91 formed on the upper surface of casing 90. This reduction gear 92 is connected to a motor 94 provided to the outside of casing 90 so that, as the motor 94 turns intermittently in the forward and rearward directions, the rotating shaft 93 of the reduction gear 93 turns repeatedly in the forward and rearward directions, thus resulting in reciprocating motion of roller 58.

Figure 6:
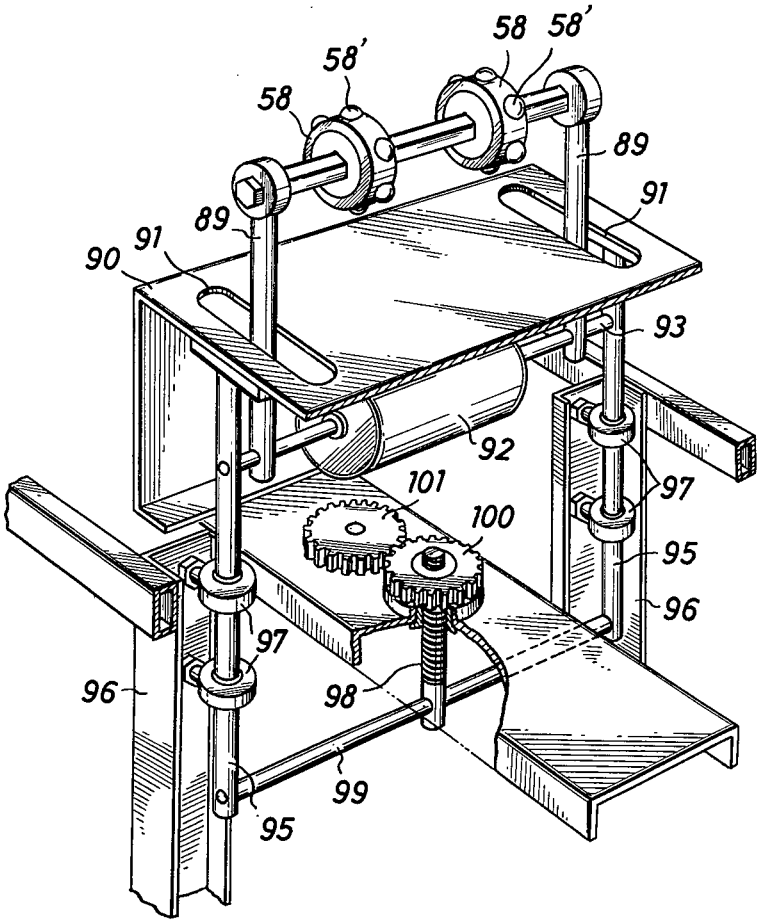
FIG. 6 is a perspective view showing a roller for massaging the lumbar and a mechanism for supporting the same.

As shown in FIG. 6, the casing 90 is fixedly provided on its both outsides with the upper ends of the slide bars 95. Each slide bar 95 is slidably retained on a bearing 97 provided on a retaining plate 96 which is vertically fixed to the bottom frame 13. The lower end of each slide bar 95 supported on bearing 97 of the retaining plate 97 is positioned below the said panel 54, while a connecting rod 99 coupled perpendicularly to a screw stock 98 is laid across the lower ends. The screw stock 98 is caused to project upwardly beyond panel 54, and is meshed with a gear 100 rotatably mounted on the panel 54. This gear 100 is in engagement with a gear 101 rotatably mounted on panel 54 in the same manner. The gear 86 is designed to be connected to a motor 102 mounted on the undersurface of panel 54 and be rotated therewith.

Accordingly, forward or rearward turning of motor 102 results in forward or rearward rotation of gears 100 and 101. As the gear 100 rotates, the screw stock 98 moves up or down so that the casing 90, ie., the roller 58 is elevated or lowered. As the heighest position, the roller 58 projects upwardly beyond the floor plate 39. At a lower position, on the other hand, the roller reaches a position below the floor plate 39, ie., where it does not come into contact with the patient's body.

It is noted that both ends of the rotating shaft 93 of the reduction gear 92 is inserted into the slide bars 95 through the rocking bars 89, whereby a load applied on the rotating shaft 93 is also dispersed into the slide bars 95, resulting in an increase in strength.

The movable frame 17 is made to stop in such a manner that the patient's waist corresponds to the roller 58, and the motor 102 is driven to elevate the roller 50 so that the roller 58 is pressed against the patient's body. Under such conditions, if the motor 94 is driven to reciprocate the roller 58, then the patient's waist can be massaged. Furthermore, since the roller 58 is provided on its circumference with a number of projections 58' unlike the other rollers, the same effect just as that attained by the fingers is obtained.

As shown in FIG. 9, each of the foregoing motors 26, 66, 73, 74, 87, 94 and 102 is connected to a control circuit 103 and operates in response to a signal therefrom. The signal from this control circuit 103 is arbitrarily selected by manipulation of an operation circuit 104, thereby separately actuating or turning off of the motors. Alternatively, each of the motors may be actuated according to a predetermined program.

Reference will now be made to the operation relation determined in the program. When a program circuit is closed by manipulation of the operation circuit 104, the motor 26 is driven to reciprocate the movable frame 17, and the motor 66 is driven to elevate the roller 59 for tracting the lower half of a patient. That is, the lower half of the patient is massaged for a given time interval by roller 59. After the lapse of the given time, the motor 73 is driven to elevate the roller 55 for correcting the backbone, so that the backbone and lower half of the patient's body are tracted and massaged by both rollers 59 and 55. Thereafter, the motor 76 is reversed to lower the roller 59 so that predetermined traction and massage are effected only by roller 55. Next, rearward rotation of motor 73 causes the roller 55 to be lowered and the motor 102 to be driven, so that the roller 58 for massaging the lumbar is elevated to give a massage thereto by roller 58. It is noted in this case that the motor 94 remains turned off, thus giving a patient a massage in the relative travel range between the roller 58 and the patient lying on the movable frame 17.

After the massage has been effected for the given time interval in the foregoing manner, the motor 26 is turned off to stop the movable frame 17 and the motor 102 is reversed to lower the roller 58. The movable frame is then controlled such that it stops at a position where the patient's waist is above the roller 59 massaging the lower half of the patient's body. After the movable frame 17 stops at a given position, the motor 66 turns repeatedly in the forward and rearward directions at given time intervals to cause up and down movement of roller 59. In other words, the patient's waist is pushed up by roller 59 so that the patient is subjected to traction treatment.

Upon completion of said traction treatment, the motor 26 turns slightly to move the movable frame to a small extent, so that the patient's waist is positioned above the roller 58 for massaging the lumbar. Thereafter, the motor 102 is driven to elevate the roller 58, and the motor 95 turns repeatedly in the forward and rearward directions to reciprocate the roller 58, thus giving the waist a massage.

Upon completion of the rubbing of the waist, the movable frame 17 again moves a little to made the patient's waist correspond to the position of vibrator 56.

Thereafter, the motor 87 is driven to elevate the vibrator 56, and the motor 74 is driven to actuate the vibrator 56.

The entire process of the program is as mentioned above, during which the whole body is systematically subjected to treatment. It will readily be understood that the heights of the rollers and vibrator can be adjusted by control of motors 66, 73, 87 and 102.

The reason for setting the program as mentioned above resides in the fact that the movable frame and each roller are adapted to be horizontally or vertically moved by the motors.

Lastly, the traction caused by each of said rollers is explained. As the roller maintained at a given height is positioned below the patient's body, the body is supported at said position as if it was lifted. Such a suspension of the body permits tension to be applied to the body in its axial direction, which tension provides a source for the force of traction.

It goes without saying that each roller has a sufficient massaging action. Consequently, a patient is subjected to massage to remove kinks and to traction, thus exercising a great synergic effect.

While a specific embodiment of the invention has been shown and described in detail to illustrate the application of the principles of the invention, it will be understood that the invention may be embodied otherwise without departing rom such principles.

What is claimed is:

1. A rhythmical traction type instrument for medical treatment including a couch having a movable frame mounted thereon in reciprocating fashion and a motor for moving said movable frame, which couch is provided with a roller for correcting the backbone, a vibrator, a reciprocating roller for massaging the lumbar and a roller for massaging the lower half of one's body, each of said rollers and vibrator being fitted with a motor for causing up and down movement thereof.

2. A rhythmical traction type instrument for medical treatment according to claim 1 in which the respective shafts of said roller for correcting the backbone and said roller for massaging the lumbar are supported between a pair of slide bars which are vertically movably supported on bearings mounted on said couch, and a screw stock which is permitted to perpendicularly intersect a connecting rod laid across said slide bars is screwed into a rotary cylinder coupled directly to a motor.

3. A rhythmical traction type instrument for medical treatment according to claim 1 in which said vibrator is laid across a pair of slide bars which are vertically movably supported on bearings mounted on said couch, a screw stock which is permitted to perpendicularly intersect a connecting rod laid across said slide bars on their lower sides is screwed from below a gear rotatably mounted within said couch, and other gear in engagement with this gear is connected to a motor.

4. A rhythmical traction type instrument for medical treatment according to claim 1 in which said vibrator is laid across a pair of slide bars which are vertically movably supported on bearings mounted on said couch, said slide bars being provided on their lower sides with longitudinal holes; a connecting rod is inserted in between said longitudinal holes; a stopper is fixed to the upper ends of said holes; a spring is interposed between said stopper and said connecting rod; a screw stock which is permitted to perpendicularly intersect said connecting rod is screwed from below a gear rotatably mounted within said couch; and other gear in engagement with this gear is connected to a motor.

5. A rhythmical traction type instrument for medical treatment according to claim 1 in which a casing is laid across the upper ends of a pair of slide bars which are vertically movably supported bearing mounted on said couch, said casing being provided with a motor which turns intermittently in the forward or rearward direction and a reduction gear connected to said motor; the rotating shaft of said reduction gear is fixed to the lower ends of a pair of rocking bars across the upper ends of which laid is a roller for massaging the lumbar; a screw stock which is permitted to perpendicularly intersect a connecting rod laid across the lower sides of said slide bars is screwed from below a gear rotatably mounted within said couch; and other gear in engagement with this gear is connected to a motor.

6. A rhythmical traction type instrument for medical treatment which houses a motor for causing vibrations and a roller for correcting the backbone which is moved up or down by forward or rearward turning of a motor, and includes a vibrator which is moved up or down by forward or rearward turning of a motor different from said motor for causing vibrations, a motor for causing separate reciprocating motion, a roller for massaging the lumbar which is moved up or down by forward or rearward turning of a motor different from said second motor, a roller for tracting the lower half of one's body which is moved up or down by forward or rearward turning of a motor, a control circuit for actuating each of said motors according to a predetermined program or separately, and an operation circuit for sending a signal to said control circuit.

7. An apparatus for medical treatment of a patient comprising, a platform, a frame slidably mounted on said platform adapted to carry and move a patient with respect to said platform, spine roller means connected to said platform having at least one spine roller movable upwardly and downwardly with respect to said frame, vibrator means connected to said platform having a vibrator head movable upwardly and downwardly with respect to said frame, lumbar roller means connected to said platform having at least one lumbar roller movable and downwardly with respect to said frame, lower body roller means connected to said platform having at least one roller body movable upwardly and downwardly with respect to said frame, and drive means connected to said frame, said at least one spine roller, said vibrator head, said at least one lumbar roller and said at least one lower body roller for movement thereof, whereby a patient carried on said frame is moved laterally past said platform and selectively treated by any combination of said at least one spine roller, lumbar roller, lower body roller and said vibrator head.

8. An apparatus for medical treatment of a patient according to claim 7, wherein said lumbar roller means further includes at least one arm connected to and carrying said at least one lumbar roller and means for rocking said arm in the direction of movement of said frame.

9. An apparatus for medical treatment of a patient according to claim 7, wherein said vibrator means includes at least one biasing spring for resiliently positioning said vibrator head with respect to said frame.

10. An apparatus according to claim 7, further including at least one cervical vertebrai roller connected to said platform and biasing means connected to said cervical vertebrai roller for biasing it toward said frame.

* * * * *